US010861432B2

(12) United States Patent
Hakuta et al.

(10) Patent No.: US 10,861,432 B2
(45) Date of Patent: Dec. 8, 2020

(54) SOUNDPROOF STRUCTURE AND OPENING STRUCTURE

(71) Applicant: FUJIFILM Corporation, Tokyo (JP)

(72) Inventors: Shinya Hakuta, Ashigara-kami-gun (JP); Shogo Yamazoe, Ashigara-kami-gun (JP); Akihiko Ohtsu, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/534,429

(22) Filed: Aug. 7, 2019

(65) Prior Publication Data

US 2019/0362699 A1 Nov. 28, 2019

Related U.S. Application Data

(63) Continuation of application No. PCT/JP2018/002647, filed on Jan. 29, 2018.

(30) Foreign Application Priority Data

Feb. 8, 2017 (JP) ..... 2017-021110

(51) Int. Cl.
*G10K 11/172* (2006.01)
*G10K 11/02* (2006.01)
(Continued)

(52) U.S. Cl.
CPC ..... *G10K 11/172* (2013.01); *E04B 1/84* (2013.01); *G10K 11/162* (2013.01)

(58) Field of Classification Search
CPC ..... G10K 11/16; G10K 11/172; G10K 11/02; G10K 11/002; G10K 11/04; E04B 1/82;
(Continued)

(56) References Cited

U.S. PATENT DOCUMENTS 5,959,265 A * 9/1999 Van Ligten ..... G10K 11/172 181/286
7,395,898 B2 7/2008 Yang et al.
(Continued)

FOREIGN PATENT DOCUMENTS

CN 1830020 A 9/2006
JP 2007-011034 A 1/2007
(Continued)

OTHER PUBLICATIONS

International Preliminary Report on Patentability dated Aug. 13, 2019 from the International Bureau in counterpart International Application No. PCT/JP2018/002647.
(Continued)

*Primary Examiner* — Edgardo San Martin
(74) *Attorney, Agent, or Firm* — Sughrue Mion, PLLC

(57) ABSTRACT

Provided are a soundproof structure and an opening structure which is easy to be manufactured, has a light weight, and is capable of absorbing sound in a wide frequency bandwidth. The soundproof structure includes a tubular member and a film member arranged so as to block a hollow portion of the tubular member. Assuming that a wavelength corresponding to a resonance frequency in a single film vibration element of the film member is $\lambda_a$, lengths from a position at which the film member is attached to two opened end surfaces of the tubular member are $L_1$ and $L_2$, an opened end correction length is $\delta$, and n is an integer of 0 or more, at least one of $(\lambda_a/4-\lambda_a/8)+n\times\lambda_a/2-\delta\leq L_1\leq(\lambda_a/4+\lambda_a/8)+n\times\lambda_a/2-\delta$ or $(\lambda_a/4-\lambda_a/8)+n\times\lambda_a/2-\delta\leq L_2\leq(\lambda_a/4+\lambda_a/8)+n\times\lambda_a/2-\delta$ is satisfied.

10 Claims, 7 Drawing Sheets

(51) Int. Cl.

| | |
|---|---|
| ***G10K 11/04*** | (2006.01) |
| ***E04B 1/84*** | (2006.01) |
| ***G10K 11/162*** | (2006.01) |
| *G10K 11/16* | (2006.01) |
| *G10K 11/00* | (2006.01) |

(58) Field of Classification Search
CPC . E04B 1/8209; E04B 1/84; E04B 1/86; E04B 1/99; E04B 2001/8476; E04B 2001/848
See application file for complete search history.

(56) References Cited

U.S. PATENT DOCUMENTS

| | | | | |
|---|---|---|---|---|
| 8,439,158 | B2 * | 5/2013 | Tanase | G10K 11/04 181/250 |
| 9,378,721 | B2 * | 6/2016 | Zalewski | G10K 11/172 |
| 10,373,599 | B2 * | 8/2019 | Hakuta | G10K 11/161 |
| 10,704,255 | B2 * | 7/2020 | Hakuta | E04B 1/86 |
| 2006/0152108 | A1 | 7/2006 | Kodama et al. | |
| 2011/0240402 | A1 | 10/2011 | Chou et al. | |
| 2018/0002919 | A1 | 1/2018 | Yamazoe et al. | |
| 2018/0114517 | A1 * | 4/2018 | Yamazoe | G10K 11/172 |
| 2019/0206380 | A1 * | 7/2019 | Hakuta | G10K 11/16 |

FOREIGN PATENT DOCUMENTS

| | | | |
|---|---|---|---|
| JP | 2009-175261 | A | 8/2009 |
| JP | 2010-097149 | A | 4/2010 |
| JP | 4832245 | B2 | 12/2011 |
| TW | 201133468 | A | 10/2011 |
| WO | 2016136959 | A1 | 9/2016 |

OTHER PUBLICATIONS

Written Opinion for PCT/JP2018/002647, dated Apr. 10, 2018.
International Search Report for PCT/JP2018/002647, dated Apr. 10, 2018.
Communication dated Jan. 19, 2020 from the State Intellectual Property Office of the P.R.C. in application No. 201880009299.3.

* cited by examiner

SOUNDPROOF STRUCTURE AND OPENING STRUCTURE

CROSS-REFERENCE TO RELATED APPLICATIONS

This application is a Continuation of PCT International Application No. PCT/JP2018/002647 filed on Jan. 29, 2018, which claims priority under 35 U.S.C. § 119(a) to Japanese Patent Application No. 2017-021110 filed on Feb. 8, 2017. The above application is hereby expressly incorporated by reference, in its entirety, into the present application.

BACKGROUND OF THE INVENTION

1. Field of the Invention

The present invention relates to a soundproof structure and an opening structure including the soundproof structure.

2. Description of the Related Art

Since the heavier the mass of a general sound insulation material, the better the sound is shielded, the sound insulation material itself becomes large and heavy in order to obtain a favorable sound insulation effect.

Thus, there is a need for a light and thin sound insulation structure as a sound insulation material corresponding to various fields such as devices, automobiles, and general households. Therefore, a sound insulation structure which attaches a frame body to a thin and light film member and controls vibration of a film has gathered attention.

For example, JP4832245B discloses a sound absorbing body that has a frame body, which has a through-hole formed therein, and a sound absorbing material, which covers one opening of the through-hole and whose first storage modulus E1 is $9.7\times10^6$ or more and second storage modulus E2 is 346 or less (refer to Abstract, Claim 1, Paragraphs [0005] to [0007] and [0034], and the like). The storage modulus of the sound absorbing material means a component, which is internally stored, of the energy generated in the sound absorbing material by sound absorption.

The sound absorbing body disclosed in JP4832245B can achieve an advanced sound absorption effect in the low-frequency region without increasing the size thereof.

U.S. Pat. No. 7,395,898A (correspondence Japanese Patent Disclosure: see JP2005-250474A) discloses an acoustic attenuation panel and an acoustic attenuation structure (see Claims 1, 12, and 15, FIG. 4, and Column 4). The acoustic attenuation panel includes an acoustically transparent two-dimensional stiffness frame which is divided into a plurality of individual cells, a sheet which is made of a flexible material and is fixed to the stiffness frame, and a plurality of sinkers. The plurality of individual cells is roughly two-dimensional cells. Each sinker is fixed to the sheet made of the flexible material such that each sinker is provided at each cell. The resonance frequency of the acoustic attenuation panel is defined by a two-dimensional shape of each individual cell, flexibility of the flexible material, and each sinker.

U.S. Pat. No. 7,395,898A discloses that the acoustic attenuation panel has the following advantages compared to the related art. That is, (1) the acoustic panel can be very thin. (2) The acoustic panel can be very light (density is low). (3) Since the panel does not follow the mass law over the wide frequency range, the panel can be laminated in order to form a locally resonant sonic material (LRSM) having a wide frequency, and can be deviated from the mass law in a frequency lower than 500 Hz in particular. (4) The panel can be easily manufactured at low cost. (see line 65 in Column 5 to line 5 in Column 6)

SUMMARY OF THE INVENTION

Incidentally, in the soundproof structure using sound absorption through film vibration as a principle, in a case where sound waves near the resonance frequency are incident on the film, the film resonates, and thus, the sound waves are absorbed. Thus, the sound absorption is performed on the sound waves having the frequency near the resonance frequency of the film vibration, and the sound waves having the frequency separated from the resonance frequency are not absorbed, and the frequency band capable of being absorbed is narrow. Accordingly, it is particularly assumed that the soundproof structure including the film member and the frame body is used for noise of which frequency characteristics are sharp as mechanical noise such as a motor noise and a gear mesh noise.

However, in the soundproof structure including the film member and the frame body, the frequency in which the sound is absorbed is changed due to a manufacturing variation, and there is a concern that noise having a target frequency will not be able to be absorbed.

In the case of the mechanical noise, there is a concern that frequency characteristics of the noise will be different due to an individual difference between devices or the frequency of the noise will be changed due to aging. Thus, in a case where the frequency band of the soundproof structure capable of absorbing the sound is narrow, there is a concern that the noise will not be able to be suitably absorbed.

In contrast, U.S. Pat. No. 7,395,898A describes that the sound is absorbed in a relatively wide frequency band as the entire soundproof structure by obtaining a configuration in which the weights of the sinkers arranged on the sheet (film) made of the flexible material of each of the plurality of cells are different, the resonance frequencies of the cells are different, and the cells attenuate the frequencies of different ranges.

However, in the configuration of U.S. Pat. No. 7,395,898A, it is necessary to provide the plurality of cells including sinkers of different weights in order to achieve widen the frequency band capable of being absorbed. Thus, it is necessary to simultaneously prepare the plurality of different cells, and the structure and manufacturing are complicated. Since it is necessary to arrange the sinkers having different weights at the cells, a manufacturing process is complicated. There is a problem that since the sinkers are required, the sound absorbing body becomes heavy.

The present invention has been made in view of the aforementioned circumstances, and an object of the present invention is to provide a soundproof structure and an opening structure which is easy to be manufactured, has a light weight, and is capable of absorbing sound in a wide frequency band.

In the present invention, "soundproof" includes the meaning of both "sound insulation" and "sound absorption" as the acoustic characteristics, and particularly refers to "sound insulation". The "sound insulation" includes "sound is insulated", that is, "sound is not transmitted". Accordingly, the "sound insulation" means that the sound is "reflected" (the reflection of the sound) and the sound is "absorbed" (the absorption of the sound). (refer to Sanseido Daijibin (Third Edition) and http://www.onzai.or.jp/question/soundproof.html and http://www.onzai.or.jp/pdf/new/gijutsu201312_3.pdf on the web page of the Japan Acoustological Materials Society).

Hereinafter, basically, "sound insulation" and "shielding" are referred to in a case where "reflection" and "absorption" are not distinguished from each other, and "reflection" and "absorption" are referred to in a case where "reflection" and "absorption" are distinguished from each other.

From the results of intensive study for achieving the aforementioned object, the present inventors have found that the aforementioned object can be solved from a soundproof structure comprising a tubular member, and a film member that is disposed so as to block a hollow portion of the tubular member, in which assuming that a wavelength corresponding to a resonance frequency in a single film vibration element of the film member is $\lambda_a$, lengths from a position to which the film member is attached to two opened end surfaces of the tubular member are $L_1$ and $L_2$, an opened end correction length is $\delta$, and n is an integer of 0 or more, at least one of $(\lambda_a/4-\lambda_a/8)+n\times\lambda_a/2-\delta\leq L_1\leq(\lambda_a/4+\lambda_a/8)+n\times\lambda_a/2-\delta$ or $(\lambda_a/4-\lambda_a/8)+n\times\Delta_a/2-\delta\leq L_2\leq(\lambda_a/4+\lambda_a/8)+n\times\lambda_a/2-\delta$ is satisfied, and have completed the present invention.

That is, the present inventors have found that the aforementioned object can be achieved with the following configuration.

(1) There is provided a soundproof structure comprising a tubular member, and a film member that is disposed so as to block a hollow portion of the tubular member. Assuming that a wavelength corresponding to a resonance frequency in a single film vibration element of the film member is $\lambda_a$, lengths from a position to which the film member is attached to two opened end surfaces of the tubular member are $L_1$ and $L_2$, an opened end correction length is $\delta$, and n is an integer of 0 or more, at least one of $(\lambda_a/4-\lambda_a/8)+n\times\lambda_a/2-\delta\leq L_1\leq(\lambda_a/4+\lambda_a/8)+n\times\lambda_a/2-\delta$ or $(\lambda_a/4-\lambda_a/8)+n\times\lambda_a/2-\delta\leq L_2\leq(\lambda_a/4+\lambda_a/8)+n\times\lambda_a/2-\delta$ is satisfied.

(2) In the soundproof structure according to (1), at least one of $(\lambda_a/4-\lambda_a/8)-\delta\leq L_1\leq(\lambda_a/4+\lambda_a/8)-\delta$ or $(\lambda_a/4-\lambda_a/8)-\delta\leq L_2\leq(\lambda_a/4+\lambda_a/8)-\delta$ is satisfied.

(3) In the soundproof structure according to (1) or (2), the wavelength $\lambda_a$ corresponding to the resonance frequency in the single film vibration element of the film member is a wavelength corresponding to a resonance frequency of a primary resonance mode of the film member.

(4) In the soundproof structure according to any one of (1) to (3), the film member is attached to one opened end surface of the tubular member.

(5) In the soundproof structure according to any one of (1) to (4), the film member is attached to a central position within the tubular member.

(6) There is provided an opening structure comprising the soundproof structure according to any one of (1) to (5), and an opening member having an opening. The soundproof structure is arranged in the opening of the opening member, and a region as a venthole through which a gas passes is provided in the opening member.

According to the present invention, it is possible to provide a soundproof structure and an opening structure which is easy to be manufactured, has a light weight, and is capable of absorbing sound in a wide frequency band.

DESCRIPTION OF THE PREFERRED EMBODIMENTS

Hereinafter, the present invention will be described in detail.

Although requirements to be described below are described based on representative embodiments of the present invention, the present invention is not limited to the embodiments.

In the present specification, a numeric range expressed by using "~" means a range including values described before and after "~" as a lower limit value and an upper limit value.

[Soundproof Structure]A soundproof structure according to an embodiment of the present invention is a soundproof structure comprising a tubular member, and a film member that is disposed so as to block a hollow portion of the tubular member. Assuming that a wavelength corresponding to a resonance frequency in a single film vibration element of the film member is $\lambda_a$, lengths from a position to which the film member is attached to two opened end surfaces of the tubular member are $L_1$ and $L_2$, an opened end correction length is $\delta$, and n is an integer of 0 or more, at least one of $(\lambda_a4-\lambda_a/8)+n\times\lambda_a/2-\delta\leq L_1\leq(\lambda_a4-\lambda_a/8)+n\times\lambda_a/2-\delta$ or $(\lambda_a4-\lambda_a/8)+n\times\lambda_a/2-\delta\leq L_2\leq(\lambda_a4-\lambda_a/8)+n\times\lambda_a/2-\delta$ is satisfied.

Hereinafter, a soundproof structure according to embodiments of the present invention will be described in detail with reference to preferred embodiments shown in the accompanying diagrams.

Figure 1:
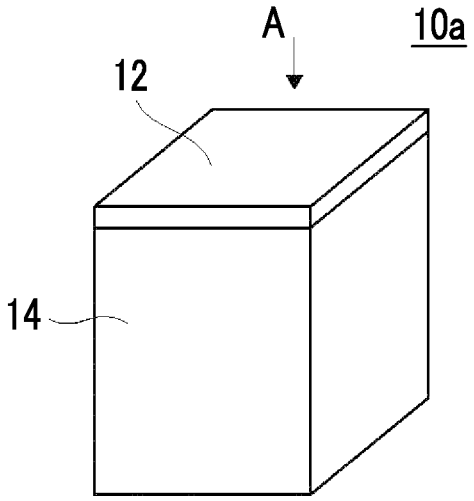
FIG. 1 is a schematic perspective view showing an example of a soundproof structure according to an embodiment of the present invention.
Figure 2:
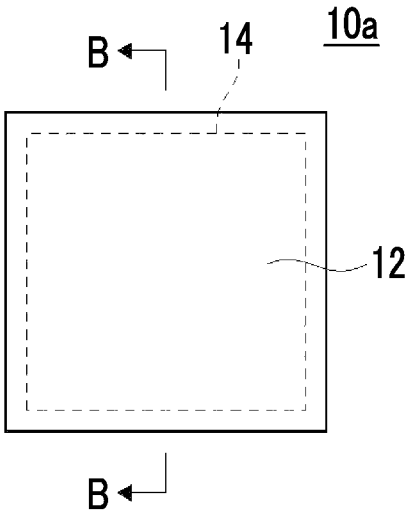
FIG. 2 is a plan view of the soundproof structure shown in FIG. 1 viewed in an A direction.
Figure 3:
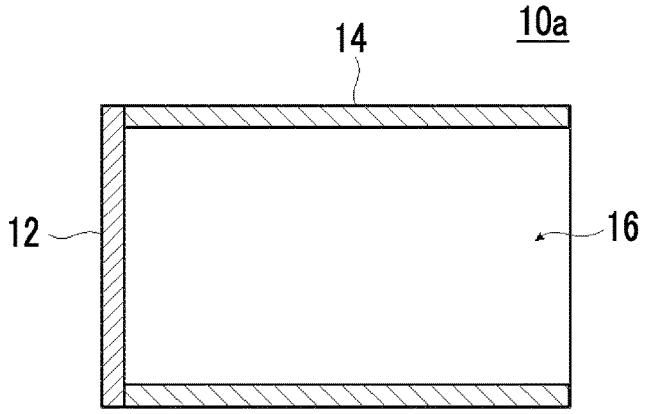
FIG. 3 is a cross-sectional view of the soundproof structure taken along line B-B of FIG. 2.

FIG. 1 is a schematic perspective view showing an example of the soundproof structure according to an embodiment of the present invention, FIG. 2 is a plan view of the soundproof structure shown in FIG. 1 viewed in an A direction, and FIG. 3 is a cross-sectional view taken along line B-B of FIG. 2.

A soundproof structure 10*a* according to the embodiment of the present invention shown in FIGS. 1 to 3 includes a tubular member 14 and a film member 12.

The tubular member 14 is a member formed so as to surround in a cyclic shape by using a thick plate-shape member (frame). That is, the tubular member 14 is a tubular member having a hollow portion 16 penetrating therethrough. In the example shown in FIG. 1, an opening part of the hollow portion 16 has a square shape, and an external shape of each opened end surface of the tubular member 14 also has a square shape.

The film member 12 is arranged on one opened end surface of the tubular member 14 so as to cover the opening part.

The film member 12 is a sheet-shaped member. The film member 12 is supported by fixing a peripheral portion to a frame on one opened end surface of the tubular member 14. The film member 12 fixed to the tubular member 14 can vibrate.

Here, in the soundproof structure according to the embodiment of the present invention, assuming that a wavelength corresponding to a resonance frequency at a single film vibration element of the film member 12 fixed to the tubular member 14 is $\lambda_a$, lengths from a position at which the film member 12 is attached to the opened end surfaces of the tubular member 14 are $L_1$ and $L_2$, an opened end correction length is $\delta$, and n is an integer of 0 or more, at least one of the length $L_1$ or $L_2$ falls in a range of $(\lambda_a 4-\lambda_a/8)+n\times\lambda_a/2-\delta$. That is, the at least one length satisfies at least one of $(\lambda_a 4-\lambda_a/8)+n\times\lambda_a 2--\leq L_1\leq(\lambda_a 4-\lambda_a/8)+n\times\lambda_a/2-\delta$ or $(\lambda_a 4-\lambda_a/8)+n\times\lambda_a/2-\delta\leq L_2\leq(\lambda_a 4-\lambda_a/8)+n\times\lambda_a/2-\delta$.

In the case shown in FIGS. 1 to 3, since the film member 12 is fixed to one opened end surface of the tubular member 14, the length from the film member 12 to the other opened end surface is a length of the tubular member 14. Accordingly, the length of the tubular member 14 is $L_1$, and satisfies $(\lambda_a 4-\lambda_a/8)+n\times\lambda_a/2-\delta\leq L_1\leq(\lambda_a 4-\lambda_a/8)+n\times\lambda_a/2-\delta$.

A relational expression between the length $L_1$ and the wavelength $\lambda_a$ will be described with reference to FIGS. 4 and 5.

Figure 4:
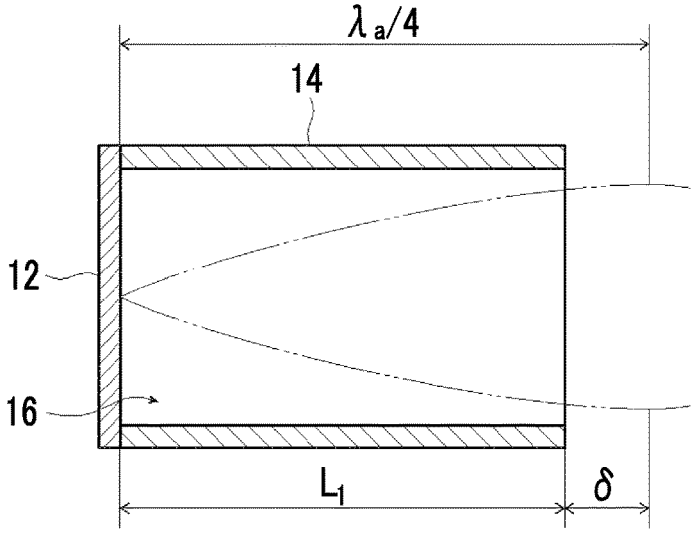
FIG. 4 is a cross-sectional view for describing an example of the relationship between a wavelength of a film vibration and a length of a tubular member according to the present invention.
Figure 5:
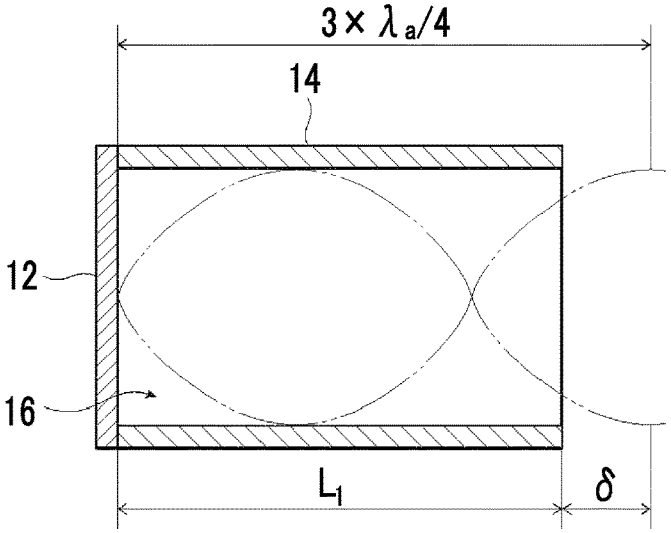
FIG. 5 is a cross-sectional view for describing another example of the relationship between a wavelength of a film vibration and a length of a tubular member according to the present invention.

FIGS. 4 and 5 are cross-sectional views for describing the relationship between the wavelength $\lambda_a$ in the resonance frequency of the single film vibration element of the film member 12 and the length $L_1$ of the tubular member 14 in the example shown in FIGS. 1 and 3. Specifically, in FIGS. 4 and 5, shape patterns of standing waves of an air column resonance occurring in a bottomed cylindrical closed tube including the tubular member 14 and the film member 12 are represented on the cross-section views of the soundproof structure 10*a* in a case where the film member 12 of the soundproof structure 10*a* is a rigid body. In FIGS. 4 and 5, the shape patterns of the standing waves of the air column resonance are represented by dashed double-dotted lines. FIG. 4 schematically shows a case where n is zero, and FIG. 5 schematically shows a case where n is 1.

Initially, the case where n is zero will be described with reference to FIG. 4.

In a case where n=0 is substituted into the relational expression between the length $L_1$ and the wavelength $\lambda_a$, the relational expression is $(\lambda_a/4-\lambda_a/8)-\delta\leq L_1\leq(\lambda_a/4+\lambda_a/8)-\delta$. That is, the relational expression is $(\lambda_a/4-\lambda_a/8)\leq L_1+\delta\leq(\lambda_a/4+\lambda_a/8)$.

As is well known, a closed end is a fixed end and is a node of the standing wave in the air column resonance in the closed tube. Meanwhile, an opened end is a free end, and is an anti-node of the standing wave. In this example, a position of anti-node of the standing wave is actually on the outside of the tube. This is referred to as opened end correction, and a distance from the opened end to the actual position of the anti-node of the standing wave is referred to as the opened end correction length $\delta$. The opened end correction length in the case of the cylindrical closed tube is given by approximately 0.61×tube radius.

Accordingly, a ¼ wavelength of a fundamental vibration in which one ¼ wavelength occurs within the closed tube (hollow portion) in the air column resonance is $L_1+\delta$, as shown in FIG. 4.

The case where $L_1+\delta$ satisfies $(\lambda_a/4-\lambda_a/8)\leq L_1+\delta\leq(\lambda_a/4+\lambda_a/8)$ means that a ¼ wavelength of the fundamental vibration of the air column resonance and a ¼ wavelength $(\lambda_a/4)$ of the wavelength $\lambda_a$ corresponding to the resonance frequency of the single film vibration element match each other with a width of $\pm\lambda_a/8$. That is, the wavelength in the resonance frequency of the air column resonance and the wavelength in the resonance frequency of the single film vibration element substantially match each other.

In this example, in a case where it is considered that $L_1+\delta=\lambda_a/2$ is satisfied, an incident wave on the tube and a reflected wave from the closed tube cancel each other in this case, and thus, the standing wave generated within the closed tube is zero. That is, in this case, an effect that the waves strengthen each other due to the closed tube is not demonstrated due to the cancellation of the waves.

In a case where $L_1+\delta$ falls in a range of from $\lambda_a/4-\lambda_a/8$ to $\lambda_a/4+\lambda_a/8$, interference between the incident wave and the reflected wave due to the closed tube has a phase relationship in which the incident wave and the reflected wave strengthen each other. Meanwhile, for example, in a case where $L_1+\delta$ falls in a range of from $\lambda_a/4+\lambda_a/8$ to $3\times\lambda_a 4-\lambda_a/8$, the interference is a phase relationship in which the incident wave and the reflected wave weaken each other.

Thus, in a case of $(\lambda_a/4-\lambda_a/8)+n\times\lambda_a/2-\delta\leq L_1\leq(\lambda_a/4+\lambda_a/8)+n\times\lambda_a/2-\delta$ which is a relationship in which the waves strengthen each other due to the closed tube, since the tube is present, $L_1$ falls in a range in which sound field is strengthened.

Next, a case where n is 1 will be described with reference to FIG. 5.

In a case where n=1 is substituted into the relational expression between the length $L_1$ and the wavelength $\lambda_a$, the relational expression is $(\lambda_a/4-\lambda_a/8)+\lambda_a/2-\delta\leq L_1\leq(\lambda_a/4+\lambda_a/8)+\lambda_a/2-\delta$. That is, the relational expression is $3\times\lambda_a/4-\lambda_a/8\leq L_1+\delta\leq 3\times\lambda_a/4+\lambda_a/8$.

The case where $L_1+\delta$ satisfies $3\times\lambda_a/4-\lambda_a/8\leq L_1+\delta\leq 3\times\lambda_a/4+\lambda_a/8$ means that ¾ wavelengths of a third harmonic vibration in which three ¼ wavelengths are generated within the closed tube (hollow portion) and the ¾ wavelengths $(3\times\lambda_a/4)$ of the resonance frequency of the single film vibration element match each other with a width of $\pm\lambda_a/8$, as shown in FIG. 5. That is, the wavelength in the resonance frequency of the air column resonance and the wavelength in the resonance frequency of the single film vibration element substantially match each other.

The same is true of a case where n is 2 or more. For example, a case where n=2 means that the relational expression is $5\times\lambda_a/4-\lambda_a/8\leq L_1+\delta\leq 5\times\lambda_a 4-\lambda_a/8$ and ⅝ wavelengths of a fifth harmonic vibration in which five ¼ wavelengths occur within the closed tube (hollow portion) and ⅝ wavelengths ($5\times\lambda_a/4$) of the resonance frequency of the single film vibration element match each other with a width of $\pm\lambda_a/8$.

As stated above, the case where the wavelength $\lambda_a$ and the length $L_1$ satisfy $(\lambda_a/4-\lambda_a/8)+n\times\lambda_a/2-\delta\leq L_1\leq(\lambda_a/4+\lambda_a/8)+n\times\lambda_a/2-\delta$ means that the wavelength in the resonance frequency of the air column resonance and the wavelength in the resonance frequency of the single film vibration element substantially match each other.

In other words, in the soundproof structure according to the embodiment of the present invention, the resonance frequency of the single film vibration element of the film member and the resonance frequency of the air column resonance in the closed tube including the tubular member and the film member in a case where it is considered that the film member is the rigid body substantially match each other.

In the present invention, it is assumed that the resonance frequency of the single film vibration element is a resonance frequency of a film vibration in a case where the film member is attached to a frame which has an opening part having the same shape and size as the opening part of the hollow portion of the tubular member and has a frame thickness capable of ignoring the influence of the air column resonance as the closed tube of the frame.

For example, it is assumed that the resonance frequency of the single film vibration element is a resonance frequency of a film vibration in a structure in which the film member is attached to the frame body constituted by the rigid body having a thickness of 1 mm and a frame thickness of 2 mm.

As stated above, in the soundproof structure in which the film member is attached to the frame body in which the through-hole is formed and sound is absorbed through the film vibration, in a case where the sound waves near the resonance frequency of the film vibration are incident on the film, the film resonates, and thus, the sound is insulated. Thus, since the sound waves of the frequency near the resonance frequency of the film vibration are insulated, there is a problem that sound waves of a frequency separated from the resonance frequency are not insulated and a frequency band that can be insulated is narrow.

In this example, in the soundproof structure including the frame body and the film member of the related art, since the frame body that can support the film member may be used, it is preferable that the length of the frame body (a thickness of the frame body in a direction perpendicular to a film surface) is short in order to reduce a size and a weight in the soundproof structure.

In general, even though two soundproof structures having shielding peaks in the same frequency are arranged in parallel, a transmittance at the shielding peak merely becomes lower, and an effect that wideband is achieved is not expected.

Accordingly, in a case where the wideband is achieved in the soundproof structure including the frame body and the film member of the related art, it is necessary to obtain a configuration in which a plurality of soundproof structures (soundproof cells) in which the resonance frequencies of the film vibration are different is provided.

In contrast, according to the examination of the present inventors, in the soundproof structure in which the film member is attached to the frame body and the sound is insulated through the film vibration, the frame body has the cylindrical shape of which the length is long, the closed tube includes the tubular member and the film member, and the resonance frequency of the air column resonance occurring in the closed tube and the resonance frequency in the single film vibration element of the film member substantially match each other. Accordingly, it can be seen that it is possible to widen the frequency band shielded by the soundproof structure. That is, it can be seen that it is possible to widen the frequency band shielded by the soundproof structure by setting the length of the tubular member according to the wavelength $\lambda_a$ corresponding to the resonance frequency in the single film vibration element.

Figure 9:
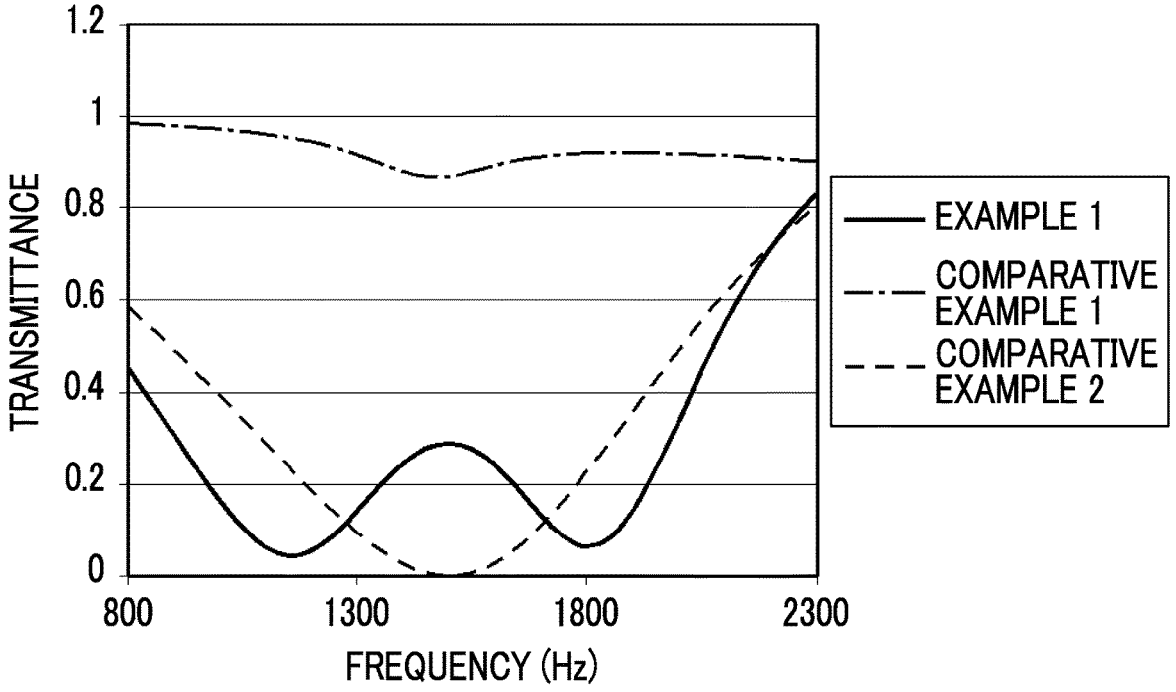
FIG. 9 is a graph showing a relationship between a frequency and a transmittance.

The widening of the frequency band will be described with reference to FIG. 9. FIG. 9 is a graph showing frequency characteristics (hereinafter, referred to acoustic characteristics) of transmittances of soundproof structures of Example 1, Comparative Example 1, and Comparative Example 2 to be described below. The acoustic characteristics shown in FIG. 9 represent the relationship between the frequency and the transmittance, and mean that the lower the transmittance, the better the sound is insulated.

The soundproof structure of Example 1 is a soundproof structure in which the length $L_1$ of the tubular member has a value obtained by subtracting the length $\delta$ of the opened end correction from the length of ¼ (that is, $\lambda_a/4$) of the wavelength $\lambda_a$ in the resonance frequency of the single film vibration element of the film member ($L_1=\lambda_a/4-\delta$).

The soundproof structure of Comparative Example 1 is a soundproof structure which has the same configuration as that of Example 1 except that the length $L_1$ of the tubular member (frame body) is 1 mm and performs soundproofing by substantially using only the film vibration.

The soundproof structure of Comparative Example 2 is a soundproof structure which has the same configuration as that of Example 1 except that the film member is the rigid body (an aluminum plate having a thickness of 2 mm) and performs soundproofing by using only the air column resonance.

As shown in FIG. 9, it can be seen that frequency characteristics of the transmittances of the soundproof structures of Comparative Example 1 and Comparative Example 2 have one shielding peak near 1472 Hz which is the resonance frequency of the film vibration or the resonance frequency of the air column resonance.

In contrast, it can be seen from FIG. 9 that the frequency characteristics of the transmittance of the soundproof structure of Example 1 which is an example of the present invention have shielding peaks in a lower frequency and a higher frequency than the resonance frequency of the film vibration and 1472 Hz which is the resonance frequency of the air column resonance, respectively. As stated above, it can be seen that since the frequency characteristics have two shielding peaks, the transmittance becomes low in a frequency band wider than that in the case of the single film vibration element and a single air column resonance element, that is, sound insulation properties become high in the wide frequency band.

As mentioned above, in the soundproof structure according to the embodiment of the present invention, since the length of the tubular member (frame body) is merely set according to the wavelength $\lambda_a$ corresponding to the resonance frequency in the single film vibration element, the configuration is simple, and it is possible to widen the frequency band to be shielded while suppressing an increase in mass. Since it is possible to widen the frequency band by appropriately setting the length of the tubular member (frame body), it is easy to manufacture the soundproof structure.

Although it has been in the example shown in FIGS. 1 to 3 that the film member is attached to the one opened end surface of the tubular member, the present invention is not limited thereto.

Figure 6:
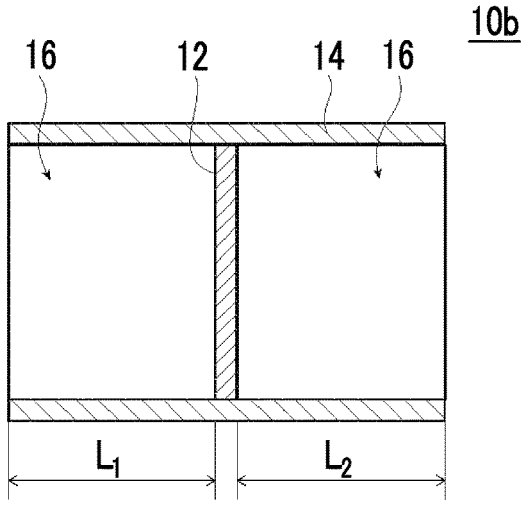
FIG. 6 is a schematic cross-sectional view showing another example of the soundproof structure according to the embodiment of the present invention.

As in a soundproof structure 10*b* shown in FIG. 6, the film member 12 may be attached within the hollow portion so as to block the hollow portion of the tubular member 14. In a case where the film member 12 is attached within the hollow portion of the tubular member 14, at least one of the length $L_1$ or $L_2$ from the film member 12 to the two opened end surfaces of the tubular member 14 may satisfy the range from $(\lambda_a/4-\lambda_a/8)+n\times\lambda_a/2-\delta$ to $(\lambda_a/4+\lambda_a/8)+n\times\lambda_a/2-\delta$. It is preferable that both the lengths $L_1$ and $L_2$ satisfy the range from $(\lambda_a/4-\lambda_a/8)+n\times\lambda_a/2-\delta$ to $(\lambda_a/4+\lambda_a/8)+n\times\lambda_a/2-\delta$.

Figure 7:
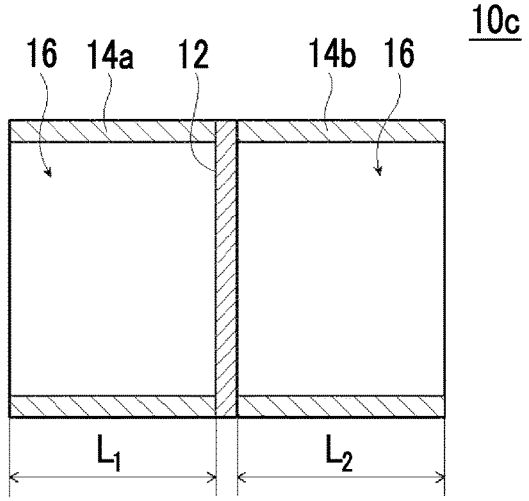
FIG. 7 is a schematic cross-sectional view showing another example of the soundproof structure according to the embodiment of the present invention.

As in a soundproof structure 10*c* shown in FIG. 7, tubular members 14*a* and 14*b* may be attached onto both surfaces of the film member 12. In a case where the tubular members 14*a* and 14*b* are attached onto both the surfaces of the film member 12, at least one of the length $L_1$ from the film member 12 to the other opened end surface of the tubular member 14*a* or the length $L_2$ from the film member 12 to the other opened end surface of the tubular member 14*b* may satisfy the range from $(\lambda_a/4-\lambda_a/8)+n\times\lambda_a/2-\delta$ to $(\lambda_a/4+\lambda_a/8)+n\times\lambda_a/2-\delta$. It is preferable that both the lengths $L_1$ and $L_2$ satisfy the range from $(\lambda_a/4-\lambda_a/8)+n\times\lambda_a/2-\delta$ to $(\lambda_a/4+\lambda_a/8)+n\times\lambda_a/2-\delta$.

It is preferable that at least one of the length $L_1$ or $L_2$ satisfies a range from $(\lambda_a/4-\lambda_a/12)+n\times\lambda_a/2-\delta$ to $(\lambda_a/4+\lambda_a/12)+n\times\lambda_a/2-\delta$, and it is preferable that at least one of the length $L_1$ or $L_2$ satisfies a range from $(\lambda_a/4-\lambda_a/16)+n\times\lambda_a/2-\delta$ to $(\lambda_a/4-\lambda_a/16)+n\times\lambda_a 2-\delta$. That is, it is preferable that a degree of coincidence between the resonance frequency in the single film vibration element and the resonance frequency of the air column resonance becomes higher.

Accordingly, it is preferable that the transmittance in the resonance frequency in the single film vibration element becomes lower.

It is preferable that at least one of the length $L_1$ or $L_2$ satisfies a range from $(\lambda_a/4-\lambda_a/8)-\delta$ to $(\lambda_a/4+\lambda_a/8)-\delta$. In other words, it is preferable that the lengths $L_1$ and $L_2$ are lengths at which the ¼ wavelength of the fundamental vibration of the air column resonance and the ¼ ($\lambda_a/4$) of the wavelength corresponding to the resonance frequency of the single film vibration element match each other with a width of $\pm\lambda_a/8$.

Accordingly, it is possible to shorten the length of the tubular member, and it is possible to reduce the size and the weight of the soundproof structure.

The wavelength $\lambda_a$ may be a wavelength in a resonance frequency of a primary resonance mode in the single film vibration element, may be a wavelength in a resonance frequency of a secondary resonance mode, or may be a wavelength in a resonance frequency a high-order (tertiary or more) resonance mode.

From the viewpoint that the size of the film member can be decreased and the size and weight of the soundproof structure can be reduced, it is preferable that the wavelength $\lambda_a$ is the wavelength in the resonance frequency of the primary resonance mode in the single film vibration element.

A soundproof structure in which the soundproof structure according to the embodiment of the present invention is used as a unit soundproof cell and a plurality of unit soundproof cells is provided may be used.

As a configuration in which the plurality of unit soundproof cells is provided, it is possible to insulate a wider frequency band by using a small number of cells by using the unit soundproof cells of which frequency bands to be shielded are different.

Next, the components of the soundproof structure according to the embodiment of the present invention will be described.

In the following description, in a case where it is not necessary to particularly distinguish between components, the soundproof structures 10*a* to 10*c* are collectively referred to as a soundproof structure 10, and the tubular members 14, 14*a*, and 14*b* are referred to as the tubular member 14.

As stated above, the soundproof structure 10 includes the tubular member 14, and the film member 12 arranged so as to block the hollow portion of the tubular member.

<Tubular Member>

As stated above, the tubular member 14 is a tubular member including the hollow portion 16 penetrating therethrough. The tubular member 14 fixes and supports the film member 12 such that the film member can vibrate, forms the bottomed cylindrical closed tube in cooperation with the film member 12, and causes the air column resonance.

Although it is preferable that the tubular member 14 has a closed continuous shape so as to fixedly restrain the entire circumference of the film member 12, the present invention is not limited thereto. The tubular member 14 may have a discontinuous shape in which a part thereof is discontinuous.

For example, the shape of the opening part of the hollow portion 16 of the tubular member 14 is not particularly limited. For example, the shape of the opening part may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, a circle, an ellipse, and the like, or may be an irregular shape. The end surfaces on both the sides of the opening part of the hollow portion of the tubular member 14 are not closed but are open to the outside as they are. That is, the hollow portion 16 penetrates through the tubular member 14.

The size of the tubular member 14 is a size in plan view, and is defined as the size of the opening part of the hollow portion 16. Hereinafter, in a case where the size of the tubular member is defined as the size of the opening part but a circle or a regular polygon such as a square, the size of the tubular member can be defined as a distance between opposite sides passing through the center or as a circle equivalent diameter. In the case of a polygon, an ellipse, or an irregular shape, the size of the tubular member 14 can be defined as a circle equivalent diameter. In the present invention, the circle equivalent diameter and the radius are a diameter and a radius at the time of conversion into circles having the same area.

The size of the tubular member 14 is not particularly limited, and the sizes of the frames may be appropriately set according to a soundproofing target to which the soundproof structure according to the embodiment of the present invention is applied in order to perform the soundproofing.

The size of the tubular member 14 may be set according to a frequency of noise as the soundproofing target such as a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier, a ventilation sleeve and window of house, and a louver window.

From the viewpoints that noise that can be sensed by humans is insulated, specifically, the size of the tubular member 14 is preferably 0.5 mm to 200 mm, more preferably 1 mm to 100 mm, and most preferably 2 mm to 30 mm.

The soundproof structure 10 itself can also be used like a partition in order to shield sound from a plurality of noise sources. Also in this case, the size of the tubular member 14 can be selected from the frequency of the target noise.

As long as the frame of the tubular member 14 reliably fixes and supports the film member 12, the thickness (hereinafter, referred to as the thickness of the tubular member) of the frame of the tubular member is not particularly limited. For example, the thickness of the tubular member 14 can be set according to the size of the tubular member.

For example, in a case where the size of the tubular member 14 is 0.5 mm to 50 mm, the thickness of the tubular member 14 is preferably 0.5 mm to 20 mm, more preferably 0.7 mm to 10 mm, and most preferably 1 mm to 5 mm.

In a case where a ratio of the thickness of the tubular member 14 to the size of the tubular member 14 is too large, an area ratio of the portion of the tubular member 14 with respect to the entire structure increases. Accordingly, there is a concern that a device will become heavy. On the other hand, in a case where the ratio is too small, it is difficult to strongly fix the film member 12 with an adhesive or the like in the tubular member 14 portion.

In a case where the size of the tubular member 14 exceeds 50 mm and is equal to or less than 200 mm, the thickness of the frame of the tubular member 14 is preferably 1 mm to 100 mm, more preferably 3 mm to 50 mm, and most preferably 5 mm to 20 mm.

As stated above, the length of the tubular member 14, that is, the thickness of the hollow portion 16 in a penetrating direction satisfies the range from $(\lambda_a/4-\lambda_a/8)+n\times\lambda_a/2-\delta$ to $(\lambda_a/4+\lambda_a/8)+n\times\lambda_a/2-\delta$. $\lambda_a$ is a wavelength corresponding to the resonance frequency in the single film vibration element of the film member 12, $\delta$ is an opened end correction length, and n is an integer of 0 or more.

The length of the tubular member 14 is not particularly limited as long as the length thereof satisfies the aforementioned expression. However, from the view points of the size or the weight with which the sound that can be sensed by humans is insulated, the length of the tubular member is preferably 4.3 mm to 4300 mm (corresponding to 20 Hz to 20000 Hz), more preferably 8.6 mm to 860 mm (corresponding to 100 Hz to 10000 Hz), and most preferably 17 mm to 285 mm (corresponding to 300 Hz to 5000 Hz).

Although it is preferable that a shape of the tubular member 14 in a longitudinal direction (the penetrating direction of the hollow portion 16) is a straight tubular, the tubular member may be curved, or may be bent in the middle.

Although it is preferable that the size and shape of the cross section (the cross section perpendicular to the penetrating direction) of the hollow portion 16 of the tubular member 14 are constant in the longitudinal direction of the tubular member 14 (the penetrating direction of the hollow portion 16), the size and shape thereof may be different. For example, the size of the cross section of the hollow portion 16 of the tubular member 14 may gradually increase from the one opened end surface to the other opened end surface. Alternatively, the size of the cross section of the hollow portion 16 of the tubular member 14 may gradually increase from the one opened end surface to the central portion, or may gradually decrease from the central portion to the other opened end surface. Alternatively, the size of the cross section of the hollow portion 16 of the tubular member 14 may gradually decrease from the one opened end surface to the central portion, or may gradually increase from the central portion to the other opened end surface.

The forming material of the tubular member 14 is not particularly limited as long as the material can support the film member 12, has a suitable strength, and is resistant to the soundproof environment of the soundproofing target, and can be selected according to the soundproofing target and the soundproof environment. For example, metal materials such as aluminum, titanium, magnesium, tungsten, iron, steel, chromium, chromium molybdenum, and nichrome molybdenum, and alloys thereof; resin materials such as acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose; and carbon fiber reinforced plastics (CFRP), carbon fibers, and glass fiber reinforced plastic (GFRP) can be used as the material of the tubular member 14.

A plurality of materials of the tubular member 14 may be used in combination.

A transparent material may be used as the material of the tubular member 14. As the transparent material, there are a transparent resin material and a transparent inorganic material. Specifically, as the transparent resin material, there are acetyl cellulose-based resins such as triacetyl celluloses; polyester-based resins such as polyethylene terephthalate (PET) and polyethylene naphthalate; olefin-based resins such as polyethylene (PE), polymethylpentene, cycloolefin polymers, and cycloolefin copolymers; acrylic resins such as polymethyl methacrylate; and polycarbonate. Meanwhile, specifically, as the transparent inorganic material, there are glass such as soda glass, potassium glass, and lead glass; ceramics such as translucent piezoelectric ceramics (PLZT); quartz, and fluorite.

In a case where the transparent material is used as the tubular member 14, an antireflection layer may be given to the tubular member 14. Accordingly, it is possible to lower visibility (hard to see), and it is possible to improve transparency.

A sound absorbing material known in the related art may be arranged within the hollow portion 16 of the tubular member 14. For example, it is possible to obtain a structure in which an air portion is left in the center of the cylinder in a donut shape by arranging the sound absorbing material along an inner wall of the tubular member.

The sound absorbing material is arranged, and thus, it is possible to more suitably adjust sound insulation characteristics due to a sound absorbing effect using the sound absorbing material.

The sound absorbing material is not particularly limited, but various known sound absorbing materials such as a Urethane plate or a non-woven fabric can be used.

<Film Member>

As stated above, the film member 12 is fixed to the tubular member 14 so as to block the hollow portion 16 of the tubular member 14, the film member absorbs or reflects the energy of sound waves to insulate sound by performing the film vibration corresponding to the sound waves from the outside. The film member forms the bottomed cylindrical closed tube in cooperation with the tubular member 14, and causes the air column resonance. For this reason, it is preferable that the film member 12 is impermeable to air.

Incidentally, since the film member 12 needs to vibrate with the tubular member 14 as the node, the film member needs to be fixed to the tubular member 14 so as to be reliably restrained by the tubular member 14, and needs to become the anti-node of the film vibration. Therefore, it is preferable that the film member 12 is made of a flexible elastic material.

For example, the shape of the film member 12 may be a shape capable of blocking the hollow portion 16 of the tubular member 14, or may be substantially the same shape as the cross-sectional shape of the hollow portion 16. The size of the film member 12 may be a size capable of blocking the hollow portion 16 of the tubular member 14, or may be greater than the size of the tubular member 14, more specifically, the size of the cross section (opening part) of the hollow portion 16 of the tubular member 14.

In this example, the film member 12 fixed to the tubular member 14 has a natural vibration frequency in which a transmission loss is minimized, for example, 0 dB, as a resonance frequency which is a frequency of a natural vibration mode. The natural vibration frequency is determined depending on the cross-sectional shape of the hollow portion of the tubular member 14 and the material and shape of the film member 12.

The soundproof structure 10 according to the embodiment of the present invention can selectively perform the soundproofing on sound of a constant frequency band using the resonance frequency as a reference by appropriately setting the resonance frequency of the single film vibration element of the film member 12.

In the soundproof structure 10 including the tubular member 14 and the film member 12, the thickness and material (Young's modulus) of the film member 12, and the size (of opening part of the hollow portion 16) of the tubular member 14 may be appropriately set in order to set the resonance frequency of the single film vibration element of the film member 12 to any frequency within an audible range.

The thickness of the film member 12 is not particularly limited as long as the film member can vibrate. In the present invention, for example, the thickness of the film member 12 can be set according to the size of the tubular member 14, that is, the size of the film member.

For example, the thickness of the film member 12 is preferably 0.005 mm (5 μm) to 5 mm, more preferably 0.007 mm (7 μm) to 2 mm, and most preferably 0.01 mm (10 μm) to 1 mm.

In this example, as stated above, in the soundproof structure 10, the resonance frequency of the single film vibration element of the film member 12 can be determined depending on a geometrical form of the tubular member 14, for example, the shape and dimension (size) of the tubular member 14, and the stiffness of the film member 12, for example, the thickness and flexibility (Young's modulus) of the film member 12.

As parameters that feature the resonance frequency of the single film vibration element of the film member 12, a ratio of a thickness (t) of the film member 12 to a size (a) of the tubular member 14 in the case of the film member 12 using the same kind of material, for example, a ratio $[a^2/t]$ of a size of one side in the case of a square can be used. In a case where this ratio $[a^2/t]$ is equal, for example, in a case where (t, a) is (50 μm, 7.5 mm) and a case where (t, a) is (200 μm, 15 mm), the resonance frequency is the same frequency, that is, the same resonance frequency. That is, the ratio $[a^2/t]$ has a constant value, and thus, the scale law is established. Accordingly, it is possible to select an appropriate size.

The Young's modulus of the film member 12 is not particularly limited as long as the film member has elasticity with which the film member 12 vibrates. For example, the Young's modulus of the film member 12 can be set according to the size of the tubular member 14, that is, the size of the film member in the present invention.

For example, the Young's modulus of the film member 12 is preferably 1000 Pa to 3000 GPa, more preferably 10000 Pa to 2000 GPa, and most preferably 1 MPa to 1000 GPa.

For example, the density of the film member 12 is not particularly limited as long as the film member can vibrate. The density of the film member is preferably 10 $kg/m^3$ to 30000 $kg/m^3$, more preferably 100 $kg/m^3$ to 20000 $kg/m^3$, and most preferably 500 $kg/m^3$ to 10000 $kg/m^3$.

In a case where a film-shaped material or a foil-shaped material is used as the material of the film member 12, the material of the film member 12 is not particularly limited as long as the material has a strength in the case of being applied to the above soundproofing target and is resistant to the soundproof environment of the soundproofing target so that the film member 12 can vibrate, and can be selected according to the soundproofing target, the soundproof environment, and the like. A material or a structure capable of forming a thin structure such as a resin material capable of being formed in a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low-density polyethylene, high-density polyethylene, aromatic polyamide, silicone resin, ethylene ethyl acrylate, vinyl acetate copolymer, polyethylene, chlorinated polyethylene, polyvinyl chloride, polymethyl pentene, and polybutene; a metal material capable of being formed in a foil shape such as aluminum, chromium, titanium, stainless steel, nickel, tin, niobium, tantalum, molybdenum, zirconium, gold, silver, platinum, palladium, iron, copper, and permalloy; a material capable of being formed as a fibrous film such as paper and cellulose; nonwoven fabrics, films including nano-sized fibers; porous materials such as thinly processed urethane and Thinsulate; and carbon materials processed into a thin film structure can be used as the material of the film member 12.

A transparent material may be used as the material of the film member 12. As the transparent material, there are a transparent resin material and a transparent inorganic material. Specifically, as the transparent resin material, there are acetyl cellulose-based resins such as triacetyl celluloses; polyester-based resins such as polyethylene terephthalate (PET) and polyethylene naphthalate; olefin-based resins such as polyethylene (PE), polymethylpentene, cycloolefin polymers, and cycloolefin copolymers; acrylic resins such as polymethyl methacrylate; and polycarbonate.

In a case where the transparent material is used as the film member 12, an antireflection layer may be given to the film member 12. Accordingly, it is possible to lower visibility (hard to see), and it is possible to improve transparency.

As stated above, a fixation position of the film member 12 in the tubular member 14 is not particularly limited. The film member 12 may be fixed on the one opened end surface of the tubular member, or may be fixed within the hollow portion 16 of the tubular member.

The method of fixing the film member 12 to the tubular member 14 is not particularly limited. Any method may be used as long as the film member 12 can be fixed to the tubular member 14 so as to serve as a node of film vibration. For example, a method using an adhesive, a method using a physical fixture, and the like can be mentioned.

For example, as the method of fixing the film member 12 onto the opened end surface of the tubular member, an adhesive may be applied on a surface that surrounds the hollow portion 16 of the tubular member 14, the film member 12 may be placed on the surface, and the film member 12 may be fixed to the tubular member 14 with an adhesive. Examples of the adhesive include epoxy based adhesives (Araldite and the like), cyanoacrylate based adhesives (Aron Alpha and the like), Super X (manufactured by CEMEDINE Co., Ltd.) and acrylic based adhesives.

The film member may be fixed by using a double-sided tape.

As a method using a physical fixture, a method can be mentioned in which the film member 12 arranged so as to cover the hollow portion 16 of the tubular member 14 is interposed between the tubular member 14 and a fixing member, such as a rod, and the fixing member is fixed to the tubular member 14 by using a fixture, such as a screw.

In a case where the film member 12 is fixed to the tubular member 14, the film member 12 may be fixed by giving tension to the film member, but it is preferable that the film member is fixed without giving the tension.

In a case where the film member 12 is fixed to the tubular member 14, at least a part of an end portion of the film member 12 may be fixed. That is, a part may be a free end, or may be a portion being simply supported without being fixed may be present. The end portion of the film member 12 is in contact with the tubular member 14. 50% or more of the end portion (peripheral portion) of the film member 12 is preferably fixed to the tubular member 14, and 90% or more of the end portion is more preferably fixed to the tubular member 14.

The tubular member 14 and the film member 12 may be made of the same material, and may be integrally formed.

The configuration in which the tubular member 14 and the film member 12 are integrally formed can be manufactured by a simple process such as compression molding, injection molding, imprinting, cut machining, and a processing method using a three-dimensional shape forming (3D) printer.

The film member 12 may be formed by boring one or more through-holes.

A sinker may be provided at the film member 12.

It is possible to adjust the resonance frequency of the single film vibration element by forming the through-hole or the sinker in the film member 12.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

Therefore, the film member is preferably flame retardancy. As the film member, for example, Lumirror (registered trademark) nonhalogen flame-retardant type ZV series (manufactured by Toray Industries) that is a flame-retardant PET film, Teijin Tetoron (registered trademark) UF (manufactured by Teijin), and/or Dialamy (registered trademark) (manufactured by Mitsubishi Plastics) that is a flame-retardant polyester film may be used.

The tubular member is also preferably a flame-retardant material. A metal such as aluminum, an inorganic material such as ceramic, a glass material, flame-retardant polycarbonate (for example, PCMUPY 610 (manufactured by Takiron)), and/or flame-retardant plastics such as flame-retardant acrylic (for example, Acrylite (registered trademark) FRI (manufactured by Mitsubishi Rayon)) can be mentioned.

As a method of fixing the film member to the tubular member, a bonding method using a flame-retardant adhesive (Three Bond 1537 series (manufactured by Three Bond)) or solder or a mechanical fixing method, such as interposing a film member between two tubular members so as to be fixed therebetween, is preferable.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film member, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray) are preferably used. In general, it is preferable to use a metal film, such as aluminum having a smaller thermal expansion factor than a plastic material.

As the tubular member, it is preferable to use heat resistant plastics, such as polyimide resin (TECASINT 4111 (manufactured by Enzinger Japan)) and/or glass fiber reinforced resin (TECAPEEK GF 30 (manufactured by Enzinger Japan)) and/or to use a metal such as aluminum, an inorganic material such as ceramic, or a glass material.

As the adhesive, it is preferable to use a heat resistant adhesive (TB 3732 (Three Bond), super heat resistant one component shrinkable RTV silicone adhesive sealing material (manufactured by Momentive Performance Materials Japan) and/or heat resistant inorganic adhesive Aron Ceramic (registered trademark) (manufactured by Toagosei)). In the case of applying these adhesives to a film member or a tubular member, it is preferable to set the thickness to 1 μm or less so that the amount of expansion and contraction can be reduced.

[Weather Resistance and Light Resistance]

In a case where the soundproof member having the soundproof structure according to the embodiment of the present invention is arranged outdoors or in a place where light is incident, the weather resistance of the structural member becomes a problem.

Therefore, as the film member, it is preferable to use a weather-resistant film, such as a special polyolefin film (ARTPLY (registered trademark) (manufactured by Mitsubishi Plastics)), an acrylic resin film (ACRYPRENE (manufactured by Mitsubishi Rayon)), and/or Scotch Calfilm (trademark) (manufactured by 3M).

As a tubular member material, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film member, a tubular member, and an adhesive having high moisture resistance. Regarding water absorption and chemical resistance, it is preferable to appropriately select an appropriate film member, tubular member, and adhesive.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK) and/or NCF (Nagaoka Sangyou)) so that the film member is not charged, it is possible to prevent adhesion of dust due to charging. It is also possible to suppress the adhesion of dust by using a fluororesin film (Dynoch Film (trademark) (manufactured by 3M)), and/or a hydrophilic film (Miraclain (manufactured by Lifegard Co.)), RIVEX (manufactured by Riken Technology Inc.) and/or SH2CLHF (manufactured by 3M). By using a photocatalytic film (Raceline (manufactured by Kimoto)), contamination of the film member can also be prevented. A similar effect can also be obtained by applying a spray having the conductivity, hydrophilic property and/or photocatalytic property and/or a spray containing a fluorine compound to the film member.

In addition to using the above special film member, it is also possible to prevent contamination by providing a cover on the film member. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing adhering dust, it is possible to remove dust by emitting sound having the resonance frequency of a film and strongly vibrating the film. The same effect can be obtained even in a case where a blower or wiping is used.

[Wind Pressure]

The film member is exposed to strong wind, and thus, the film member is pressed. As a result, there is a possibility that the resonance frequency will be changed. Thus, nonwoven fabric, urethane, and/or a film is covered on the film member, and thus, it is possible to suppress the influence of the wind.

[Arrangement]

Since the soundproof member including the soundproof structure according to the embodiment of the present invention can be easily attached to or detached from the wall, it is preferable that an attachment mechanism constituted by a magnetic body, Velcro (registered trademark), a button, or a suction cup is attached to the soundproof member. For example, the attachment mechanism may be attached to a side surface of the tubular member 14, the attachment mechanism may be attached to the wall, and the soundproof member may be attached to the wall. The attachment mechanism attached to the soundproof member may be detached from the wall, and the soundproof member may be separated from the wall.

For example, the multiple kinds of soundproof structures according to the embodiment of the present invention can be arranged in a duct. In this case, since the soundproofing is performed in the frequencies corresponding to the soundproof structures by arranging the soundproof structures of which frequencies to resonate are different, the soundproof structures can further have wide-band soundproofing characteristics as a whole. As the arrangement method, the soundproof structures may be arranged in an axial direction within the duct in series, or the plurality of soundproof structures may be present in a parallel direction on an opening cross section.

The soundproof structure according to the embodiment of the present invention can be used together with other kinds of soundproof members. For example, it is possible to simultaneously demonstrate the characteristics of another soundproof member and the characteristics of the soundproof structure according to the embodiment of the present invention by obtaining a configuration in which at least one of a sound absorbing material (urethane, glass wool, microfiber (such as Thinsulate manufactured by 3M), gypsum board, fine through-hole membrane), or the soundproof structure (Helmholtz resonance structure, film vibration structure, or an air column resonance structure) and the soundproof structure according to the embodiment of the present invention are arranged. For example, it is possible to simultaneously arrange the soundproofing member and the soundproof structure in the duct or it is possible to simultaneously arrange the soundproofing member and the soundproof structure to a wall of a room.

In a case where the soundproof structures of which frequency bands to be insulated are different are combined as the soundproof cells, it is preferable that the attachment mechanism such as a magnetic body, Velcro (registered trademark), a button, and an absorption cup is attached to each soundproof cell such that the soundproof cells are easily combined.

The soundproof cells may be attached by forming a recess portion and a protrusion portion at each soundproof cell and engaging the protrusion portion of one soundproof cell with the recess portion of the other soundproof cell. In a case where the plurality of soundproof cells is combined, both the protrusion portion and the recess portion may be formed at one soundproof cell.

The soundproof cell may be attached by combining the aforementioned attachment mechanism with the protrusion portion and the recess part.

[Frame Mechanical Strength]

As the size of the soundproof member including the soundproof structure according to the embodiment of the present invention becomes large, the tubular member tends to vibrate, and a function as the fixed end for the film vibration is degraded. Thus, it is preferable that the frame stiffness increases by increasing the thickness of the frame of the tubular member. However, in a case where the thickness of the frame increases, the mass of the soundproof member increases, the advantage of the present soundproof member of which the weight is light is degraded.

Thus, since the increase in mass is reduced while maintaining high stiffness, it is preferable that a hole or a groove is formed in the frame. For example, a truss structure or a Rahmen structure is used as the frame, and thus, it is possible to achieve both high stiffness and light weight.

The soundproof structure according to the embodiment of the present invention is basically configured as described above.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening part (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening part (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site to prevent leakage of a lot of noise around the construction site); and a soundproof member for tunnel (soundproof member installed in a tunnel to prevent noise leaking to the inside and outside the tunnel).

[Opening Structure]

An opening structure according to an embodiment of the present invention is an opening structure comprising the soundproof structure, and an opening member having an opening. The soundproof structure is arranged in the opening of the opening member, and a region as a venthole through which a gas passes is provided in the opening member.

In the opening structure, it is preferable that the soundproof structure is arranged such that a perpendicular direction of the film surface of the film member is at an angle as close as possible to a direction perpendicular to the opening cross section of the opening member.

Figure 8:
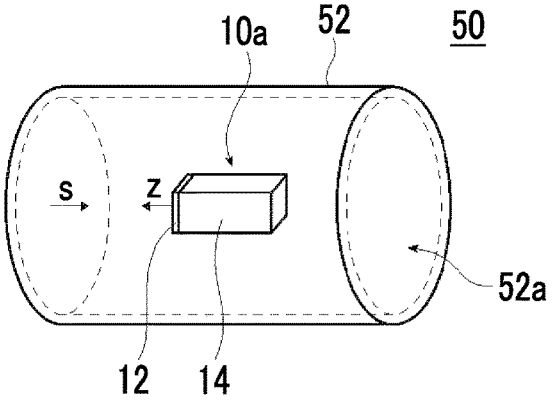
FIG. 8 is a perspective view showing an example of an opening structure according to the embodiment of the present invention.

FIG. 8 is a schematic cross-sectional view showing an example of an opening structure according to the embodiment of the present invention.

An opening structure 50 shown in FIG. 8 includes the soundproof structure 10*a* and an opening member 52. The soundproof structure 10*a* is arranged within an opening of the opening member 52.

As shown in FIG. 8, in the opening structure 50, it is preferable that the soundproof structure 10*a* is arranged such that a perpendicular direction z of the film surface of the film member 12 is parallel to a direction s perpendicular to the opening cross section of the opening member 52. A region as a venthole through which a gas can pass is formed between the opening of the opening member 52 and the soundproof structure 10*a* arranged within the opening.

The soundproof structure 10*a* of FIG. 8 is a soundproof structure having the same configuration as that of the soundproof structure 10*a* shown in FIG. 1. As stated above, the soundproof structure used in the opening structure according to the embodiment of the present invention includes the film member 12 and the tubular member 14. The soundproof structure may be configured such that the resonance frequency in the single film vibration element of the film member and the resonance frequency of the air column resonance in the closed tube including the tubular member and the film member in a case where the film member is the rigid body substantially match each other.

In a case where the opening member 52 is a tubular member having a length of a duct and the soundproof structure 10*a* is arranged within the opening member 52, since sound travels in the direction s substantially perpendicular to the opening cross section within the opening of the opening member 52, the direction s substantially perpendicular to the opening cross section is a direction of a sound source. Accordingly, the soundproof structure is arranged such that the perpendicular direction z of the film surface is parallel to the direction of the sound source as the soundproofing target by arranging the perpendicular direction z of the film surface of the film member 12 in parallel with the direction s perpendicular to the opening cross section of the opening member 52. That is, the sound is perpendicularly incident on the film surface.

Although it has been described in the example shown in FIG. 8 that the soundproof structure 10*a* is arranged such that the perpendicular direction z of the film surface of the film member 12 is substantially parallel to the direction s perpendicular to the opening cross section of the opening member 52, the present invention is not limited thereto. The soundproof structure 10*a* may be arranged such that the perpendicular direction z of the film surface of the film member 12 intersects the direction s perpendicular to the opening cross section of the opening member 52.

It is preferable that the direction s perpendicular to the opening cross section of the opening member 52 and the perpendicular direction z of the film surface of the film member 12 of the soundproof structure 10*c* are approximately parallel to each other from the viewpoints that sound absorbing performance, air permeability, that is, the venthole increases and the amount of wind applied to the film surface decreases in the case of a noise structure such as a fan which blows a wind.

Although it has been described in the illustrated diagram that the soundproof structure 10*a* is arranged within the opening of the opening member 52, the present invention is not limited thereto. The soundproof structure 10*a* may be arranged in a position protruding from the end surface of the opening member 52. Specifically, it is preferable that the soundproof structure is arranged within an opened end correction length from the opened end of the opening member 52. In a case where the opening member 52 is used, the anti-node of the standing wave of the sound field protrudes to the outside of the opening of the opening member 52 by the opened end correction length, and it is possible to demonstrate the soundproofing performance even on the outside of the opening member 52. The opened end correction length in the case of the cylindrical opening member 52 is given by approximately 0.61×tube radius (radius of an inner peripheral portion).

Although it has been described in this example that the soundproof structure 10*a* including one soundproof cell within the opening member 52 is arranged in the opening structure 50 shown in FIG. 8, the present invention is not limited thereto. The soundproof structure including two or more soundproof cells may be arranged within the opening member 52. Alternatively, the opening structure may have a configuration in which the plurality of soundproof structures is arranged within the opening member 52.

In the present invention, it is preferable that the opening member has an opening formed in a region of an object which blocks the passage of the gas, and it is preferable that the opening member is provided on a wall that separates two spaces.

The object which has the region in which the opening is formed and blocks the passage of the gas refers to a member and a wall that separates two spaces. The member refers to a member such as a tube or a cylinder. Examples of the wall include a fixed wall constituting a structure of a construction such as a house, a building, or a factory, a fixed wall such as a fixed partition which is arranged within a room of the construction to divide the room, or a movable wall such as a movable partition which is arranged within the room of the construction to divide the room.

In the present invention, the opening member is a member having an opening part such as a window frame, a door, a doorway, a ventilating hole, a duct part, or a louver for ventilation, heat dissipation, or movement of substances. That is, the opening member may be a tubular member or a tube such as a duct, a hose, or a pipe, may be a wall having a ventilating hole portion attached to a louver window and an opening for attaching a window, may be a portion constituted by a partition upper portion, a ceiling, or a wall, or may be a window member such as a window frame attached to the wall. That is, it is preferable that a portion surrounded by a closed curve is an opening part and the soundproof structure according to the embodiment of the present invention is arranged within the opening part.

For example, in the present invention, as long as the soundproof structure can be arranged in the opening of the opening member, the cross-sectional shape of the opening may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, an ellipse, and the like, or may be an irregular shape.

In the present invention, the material of the opening member is not particularly limited, and may be a metal material, a resin material, a reinforced plastic material, a carbon fiber, and a wall material. Examples of the metal material include metal materials such as aluminum, titanium, magnesium, tungsten, iron, steel, chromium, chromium molybdenum, nichrome molybdenum, and alloys thereof. Examples of the resin material include resin materials such as acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose. The reinforced plastic material includes carbon fiber reinforced plastics (CFRP) and glass fiber reinforced plastics (GFRP). The wall material can be a wall material such as the same concrete, mortar, or wood as the wall material of the construction.

EXAMPLES

The soundproof structure according to the embodiment of the present invention will be described in detail by way of examples. The materials, the amount to be used, the proportion, the processing content, and the processing procedure shown in the following examples can be appropriately changed without departing from the spirit of the present invention. Accordingly, the scope of the present invention should not be interpreted as being limited by the following examples.

Comparative Example 1

Initially, as Comparative Example 1, the soundproof structure of which the length of the tubular member is set so as to be regarded as the single film vibration element of the film member was manufactured, and the acoustic characteristics were measured.

Specifically, a PET film (Lumirror S10 manufactured by TORAY INDUSTRIES, INC.) having a thickness of 188 μm was used as the film member. A frame body of which a length is 1 mm, a shape of the opening part is a square of 20 mm×20 mm, and a frame thickness is 2 mm was used as the tubular member.

The soundproof structure was manufactured by fixing the PET film to the one opened end surface of the tubular member by using the double-sided tape (Genbapower manufactured by ASKUL Corporation, 20 mm).

The frequency characteristics of the transmittance of the manufactured soundproof structure were measured by using a four-terminal method using an acoustic tube.

An acoustic tube having a rectangular cross section of 40 mm×24 mm was used as the acoustic tube.

This method is based on "ASTM E2611-09: Standard Test Method for Measurement of Normal Incidence Sound Transmission of Acoustical Materials Based on the Transfer Matrix Method". The measurement using a transfer function method is performed by using four microphones as the acoustic tube. It is possible to measure the sound transmission loss in a wide spectral band using this method.

The soundproof structure was arranged in the central portion of the acoustic tube. An orientation of the soundproof structure was an orientation in which the film surface of the film member matches the cross section of the acoustic tube. The frequency range to be measured was 300 Hz to 2500 Hz.

FIG. 9 shows the relationship between the measured transmittance and frequency.

As shown in FIG. 9, the frequency characteristics with which the transmittance is a minimum value in 1472 Hz were represented. As predicted from the material and thickness of the film member, it is considered that this frequency is the primary resonance frequency.

In this example, since the length of the tubular member of the soundproof structure of Comparative Example 1 is 1 mm, it is possible to regard the frequency characteristics of Comparative Example 1 as substantially being the frequency characteristics of the single film vibration element.

Comparative Example 2

As Comparative Example 2, the soundproof structure as the closed tube which has the same opening part shape as the opening part shape of the soundproof structure of Comparative Example 1 and causes the air column resonance as the substantially same resonance frequency as the resonance frequency of the single film vibration element of the soundproof structure of Comparative Example 1 was manufactured, and the acoustic characteristics were measured.

Specifically, the soundproof structure was manufactured similarly to Comparative Example 1 except that the length of the tubular member is 52 mm and the film member is changed to an aluminum plate having a thickness of 2 mm. In this case, the opening part area is 400 $mm^2$, and thus, the opened end correction length δ can be calculated as 6.9 mm.

In a case where the opened end correction length δ is 6.9 mm and a sound speed is 343 m/s, the primary resonance frequency of the air column resonance is calculated as 1456 Hz from the length of the soundproof structure.

FIG. 9 shows the relationship between the measured transmittance and frequency. As shown in FIG. 9, the frequency characteristics with which the transmittance is the minimum value near 1456 Hz were represented.

Example 1

Next, as Example 1, the soundproof structure in which the resonance frequency of the single film vibration element of the soundproof structure and the resonance frequency of the air column resonance substantially match each other was manufactured, and the acoustic characteristics were measured.

Specifically, the soundproof structure was manufactured similarly to Comparative Example 1 except that the length of the tubular member is 52 mm.

That is, the resonance frequency of the single film vibration element of the soundproof structure of Example 1 is 1472 Hz similarly to Comparative Example 1, and the resonance frequency of the single air column resonance element in a case where the film member is the rigid body is 1456 Hz similarly to Comparative Example 2. That is, the soundproof structure of Example 1 has the structure in which the resonance frequency of the single film vibration element and the resonance frequency of the single air column resonance element substantially match each other.

The wavelength $\lambda_a$ is calculated as 231 mm from 1472 Hz which is the resonance frequency of the single film vibration element. In a case where $L=\lambda_a/4+n\times\lambda_a/2-\delta$ is calculated from the value of the wavelength $\lambda_a$ (n=0), it can be seen that L is about 51 mm, 52 mm which is the length of the tubular member falls within the range of $(\lambda_a/4\pm\lambda_a/8)+n\times\lambda_a/2-\delta$ (n=0), that is, the range from 22.2 mm to 79.7 mm.

A graph representing the relationship between the measured transmittance and frequency is shown in FIG. 9.

It can be seen from FIG. 9 that the single film vibration element of the film member (Comparative Example 1) or the single air column resonance element in a case where the film member is the rigid body (Comparative Example 2) has the frequency characteristics with which the transmittance is the minimum value near 1500 Hz close to the resonance frequency.

In contrast, in Example 1 of the present invention, two frequencies of 1176 Hz and 1833 Hz appear as the minimum values of the transmittance irrespective of the structure in which these two substantially same resonance frequencies are superimposed.

A transmittance of less than 0.3 is maintained even in the frequency between the two minimum values. Accordingly, it can be seen that it is possible to decrease the transmittance over a very wide band as compared to Comparative Examples of the single film vibration element and single air column resonance element of the film member.

Figure 10:
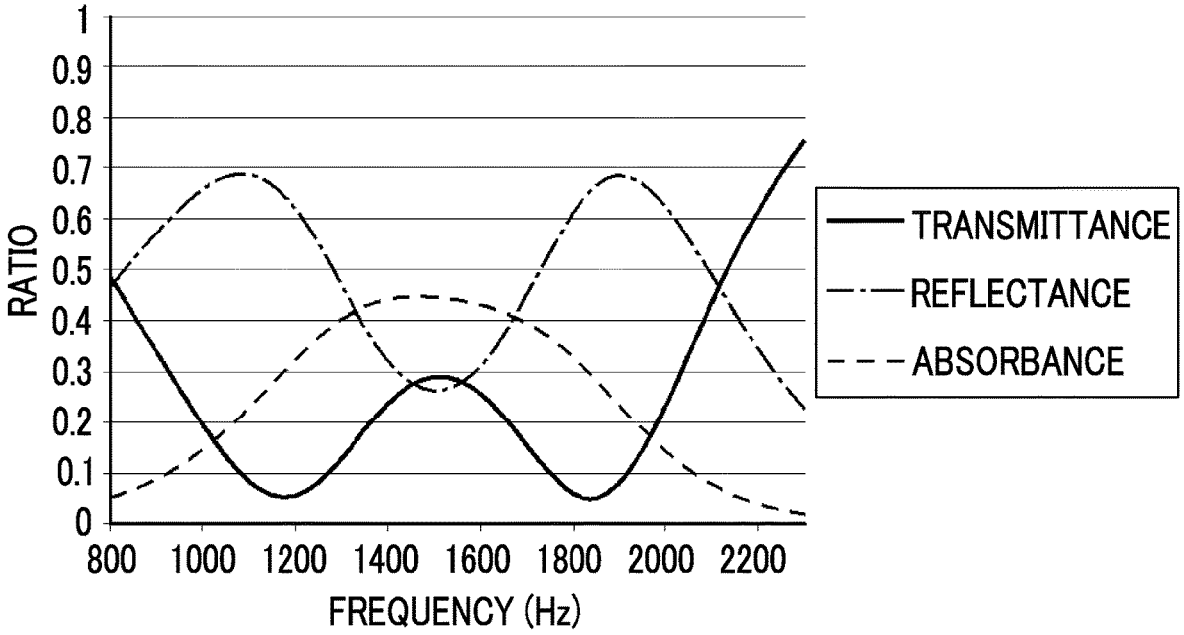
FIG. 10 is a graph showing sound insulation characteristics of the soundproof structure of Example 1.

In FIG. 10, the frequency characteristics of the transmittance, reflectance, and absorbance of Example 1 were shown.

It can be seen that the reflectance increases at the two minimum values of the transmittance. It can be seen that absorption increases in the frequency between the two minimum values and the transmittance decreases as a whole.

Examples 2 to 13 and Comparative Examples 3 to 7

As represented in Table 1, the soundproof structure was manufactured similarly to Example 1 except that the length of the tubular member is changed in a range from 10 mm to 100 mm, and the acoustic characteristics were measured.

The results are represented in Table 1.

In this example, in Table 1, an air column resonance main resonance frequency is a frequency at the minimum value, of the two minimum values of the transmittance, at which the frequency is close to the resonance frequency of the single air column resonance element. A film vibration main resonance frequency is a frequency at the minimum value, of the two minimum values of the transmittance, at which the frequency is far from the resonance frequency of the single air column resonance element.

A difference in the resonance frequency from the single film vibration element is a difference between the resonance frequency of the single film vibration element (resonance frequency of Comparative Example 1) and the film main resonance frequency.

An average transmittance is an average transmittance obtained in the range from 1176 Hz to 1833 Hz by using the frequencies (1176 Hz and 1833 Hz) of the two minimum values of the transmittance in Example 1 as the reference.

Figure 14:
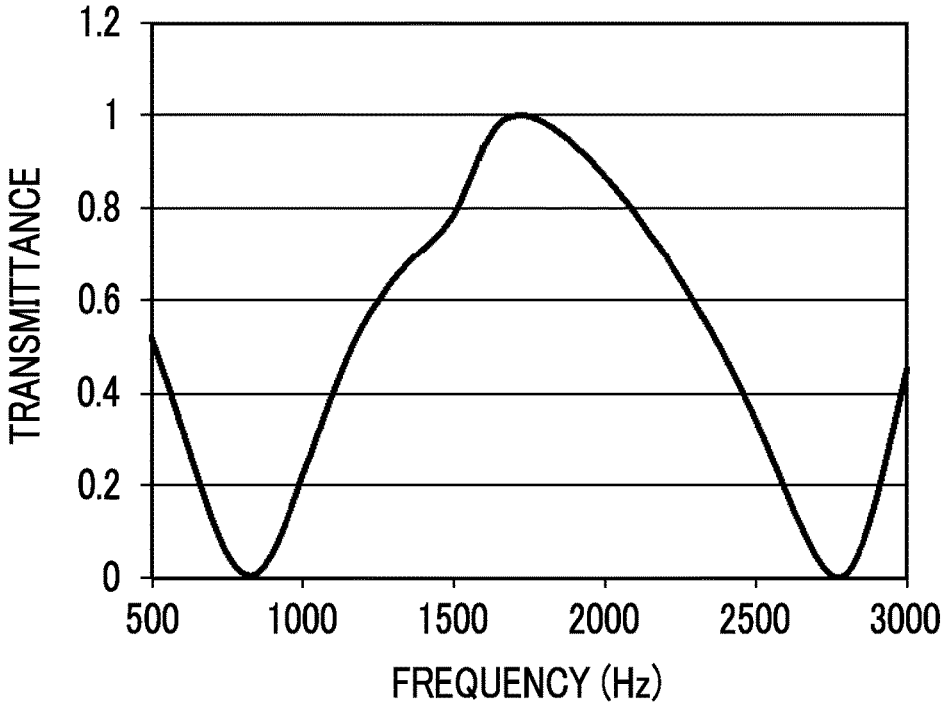
FIG. 14 is a graph showing a relationship between a frequency and a transmittance of a soundproof structure of Comparative Example 6.

In FIG. 14, a graph representing the relationship between the transmittance and the frequency of Comparative Example 6 is shown.

In the graph shown in FIG. 14, the minimum value near 800 Hz is caused by the primary resonance frequency of the air column resonance, and the minimum value near 2800 Hz is caused by the secondary resonance frequency of the air column resonance. An inflection point near 1500 Hz is derived from the film vibration, but is not the minimum value. Accordingly, in Table 1, the film main resonance frequency of Comparative Example 6 is described in "none". The same is true of Comparative Example 7.

TABLE 1

| | Length mm of tubular member | Resonance frequency Hz of single air column resonance element | Air column resonance main resonance frequency Hz | Film main resonance frequency Hz | Difference Hz in resonance frequency from single film vibration element | Transmittance @1472 Hz | Average transmittance |
|---|---|---|---|---|---|---|---|
| Comparative Example 1 | 1 | — | — | 1472 | — | 0.87 | 0.9 |
| Comparative Example 3 | 10 | 5079 | >4000 | 1428 | 44 | 0.69 | 0.74 |
| Comparative Example 4 | 20 | 3190 | 3530 | 1380 | 92 | 0.52 | 0.56 |
| Example 2 | 30 | 2325 | 2634 | 1330 | 142 | 0.40 | 0.4 |
| Example 3 | 40 | 1829 | 2154 | 1274 | 198 | 0.33 | 0.26 |
| Example 4 | 42 | 1754 | 2081 | 1263 | 209 | 0.32 | 0.24 |
| Example 5 | 44 | 1685 | 2024 | 1241 | 231 | 0.31 | 0.22 |
| Example 6 | 46 | 1622 | 1971 | 1227 | 245 | 0.30 | 0.2 |
| Example 7 | 48 | 1562 | 1922 | 1216 | 256 | 0.30 | 0.18 |

TABLE 1-continued

| | Length mm of tubular member | Resonance frequency Hz of single air column resonance element | Air column resonance main resonance frequency Hz | Film main resonance frequency Hz | Difference Hz in resonance frequency from single film vibration element | Transmittance @1472 Hz | Average transmittance |
|---|---|---|---|---|---|---|---|
| Example 8 | 50 | 1507 | 1876 | 1191 | 281 | 0.29 | 0.17 |
| Example 1 | 52 | 1456 | 1833 | 1176 | 296 | 0.29 | 0.17 |
| Example 9 | 54 | 1408 | 1161 | 1801 | 329 | 0.29 | 0.17 |
| Example 10 | 56 | 1364 | 1133 | 1772 | 300 | 0.29 | 0.18 |
| Example 11 | 58 | 1322 | 1121 | 1736 | 264 | 0.30 | 0.2 |
| Example 12 | 60 | 1282 | 1095 | 1717 | 245 | 0.31 | 0.22 |
| Example 13 | 70 | 1115 | 995 | 1603 | 131 | 0.38 | 0.42 |
| Comparative Example 5 | 80 | 987 | 908 | 1476 | 4 | 0.55 | 0.65 |
| Comparative Example 6 | 90 | 885 | 825 | None | — | 0.79 | 0.81 |
| Comparative Example 7 | 100 | 802 | 762 | None | — | 0.98 | 0.89 |

From the results shown in Table 1, in Examples 1 to 13 in which the length of the tubular member falls in the range from $(\lambda_a/4-\lambda_a/8)+n\times\lambda_a/2-\delta$ to $(\lambda_a/4+\lambda_a/8)+n\times\lambda_a/2-\delta$, that is, the range from 22.2 mm to 79.7 mm, the transmittance in 1472 Hz is less than 0.5, and the average transmittance in 1176 Hz to 1833 Hz is also less than 0.5. Accordingly, it can be seen that it is possible to perform the sound absorption in the wide frequency band.

Figure 11:
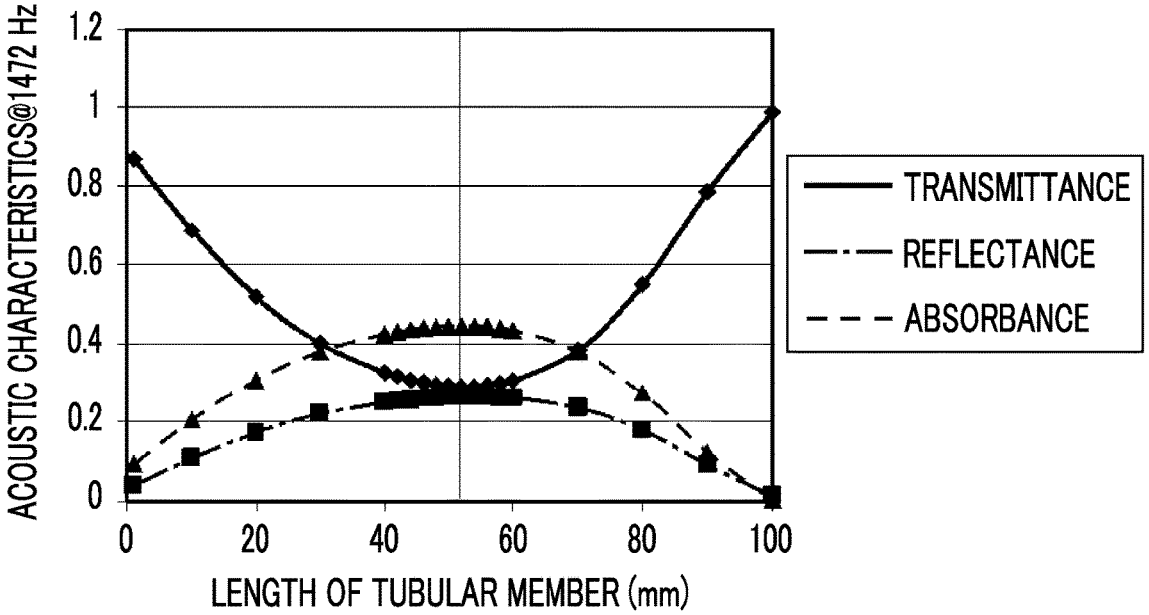
FIG. 11 is a graph showing a relationship between acoustic characteristics and a length of the tubular member.

From the results of Examples 1 to 13 and Comparative Examples 1 to 7, the relationship between the length of the tubular member and the transmittance, reflectance, and absorbance in 1472 Hz is shown as a graph in FIG. 11.

As shown in FIG. 11, it can be seen that as the length of the tubular member becomes closer to the length at which the resonance frequency of the single air column resonance element and the resonance frequency of the single film vibration element substantially match each other, the transmittance, the reflectance, and the absorbance in 1472 Hz are improved.

Figure 12:
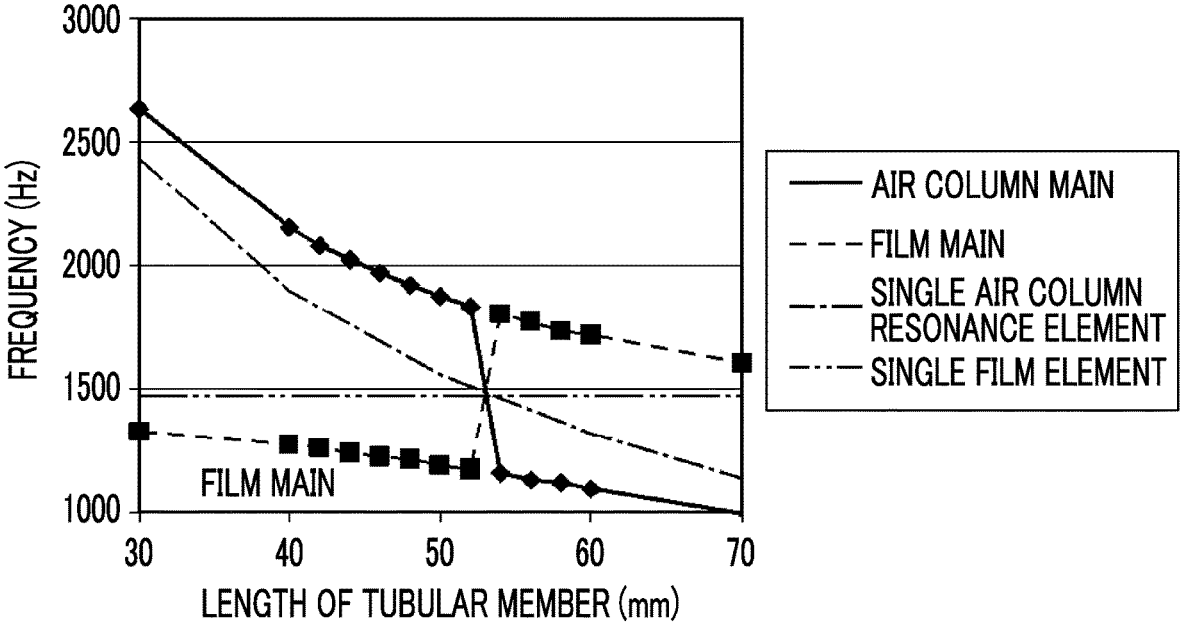
FIG. 12 is a graph showing a relationship between the length of the tubular member and a peak frequency of the transmittance.

From the results of Examples 1 to 13 and Comparative Examples 1 to 7, the length of the tubular member, the resonance frequency of the single air column resonance element, the resonance frequency of the single film vibration element, the air column resonance main resonance frequency, and the film main resonance frequency is shown as a graph in FIG. 12.

It can be seen from FIG. 12 that as the length of the tubular member becomes further from the position at which the resonance frequency of the single air column resonance element and the resonance frequency of the single film vibration element intersect each other, the air column resonance main resonance frequency is close to the resonance frequency of the single air column resonance element and the film main resonance frequency is close to the resonance frequency of the single film vibration element. That is, as the resonance frequency of the single air column resonance element and the resonance frequency of the single film vibration element become further from each other, since interaction is reduced, these main resonance frequencies are close to the resonance frequency of the single air column resonance element or the single film vibration element.

Figure 13:
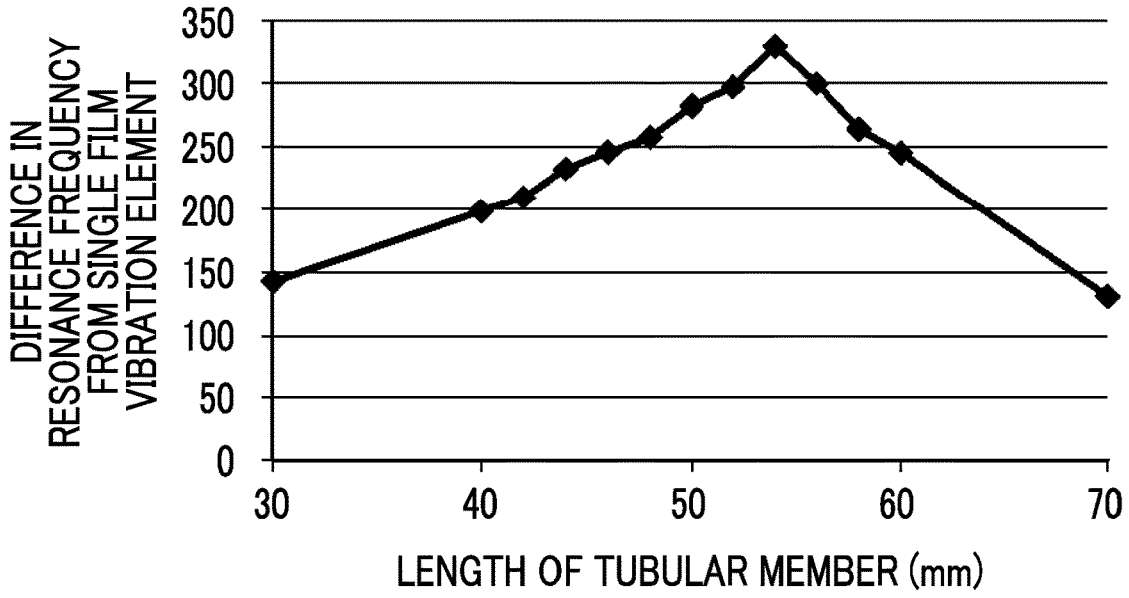
FIG. 13 is a graph showing a relationship between a frequency different from a film resonance element and the length of the tubular member.

From the results of Examples 1 to 13 and Comparative Examples 1 to 7, the relationship between the length of the tubular member and the difference in the resonance frequency from the single film vibration element is shown as a graph in FIG. 13.

It can be seen from FIG. 13 that as the length of the tubular member becomes closer to the length at which the resonance frequency of the single air column resonance element and the resonance frequency of the single film vibration element substantially match each other, the difference in the resonance frequency from the single film vibration element increases.

Example 14

Next, as Example 14, a case where the tubular members are arranged on both sides of the film member was examined.

Specifically, the soundproof structure was manufactured similarly to Example 1 except that the tubular member is also arranged on a surface on which the tubular member of the film member is not arranged, and the acoustic characteristics are measured.

That is, a sleeve having a length of 52 mm is attached to one side of the film in Example 1, whereas sleeves having a length of 52 mm are attached to both sides of the film in Example 14.

Figure 15:
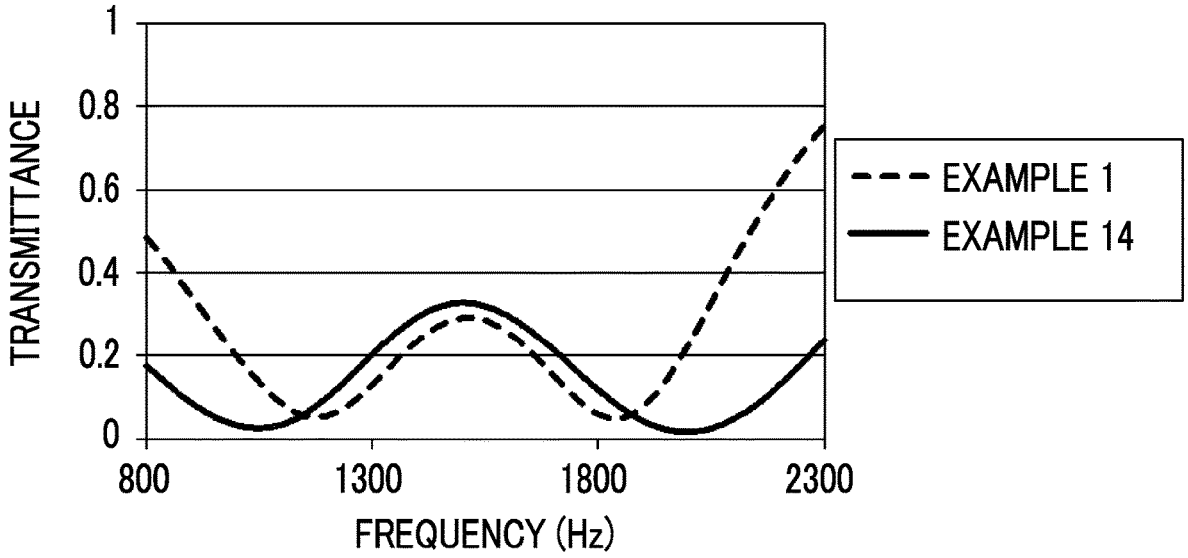
FIG. 15 is a graph showing a relationship between a frequency and a transmittance of a soundproof structure.

In FIG. 15, a graph that represents the relationship between the transmittance and the frequency through in comparison with Example 1 is shown. The evaluation results of the acoustic characteristics are represented in Table 2.

TABLE 2

| | Arrangement of tubular member | Length mm of tubular member | Resonance frequency Hz of single air column resonance element | Air column resonance main resonance frequency Hz | Film main resonance frequency Hz | Difference Hz in resonance frequency from single film vibration element | Transmittance @1472 Hz | Average transmittance |
|---|---|---|---|---|---|---|---|---|
| Example 1 | One Side | 52 | 1456 | 1833 | 1176 | 296 | 0.29 | 0.17 |
| Example 14 | Both Sides | 52 | 1456 | 1988 | 1046 | 427 | 0.32 | 0.22 |

In comparison with Example 1 in which the sleeve is present on only one side from FIG. 15 and Table 2, it can be seen that both the peak frequencies in which the transmittance is minimized spread by providing the sleeves on both sides of the film member. From the aforementioned results, in a case where it is desired to obtain the wider band, it can be seen that the structure of which both sides are provided with the sleeves effectively functions.

From the above, the effect of the soundproof structure according to the embodiment of the present invention is obvious.

While the soundproof structure and the opening structure according to the embodiment of the present invention have been described in detail with reference to various embodiments and examples, the present invention is not limited to these embodiments and examples, and various improvements or modifications may be made without departing from the scope and spirit of the present invention.

EXPLANATION OF REFERENCES

10*a*, 10*b*, 10*c*: soundproof structure
12: film member
14, 14*a*, 14*b*: tubular member
16: hollow portion
50: opening structure
52: opening member
52*a*: opening

What is claimed is:

1. A soundproof structure comprising:
a tubular member; and
a film member that is disposed so as to block a hollow portion of the tubular member,
wherein, assuming that a wavelength corresponding to a resonance frequency in a single film vibration element of the film member is $\lambda_a$, lengths from a position to which the film member is attached to two opened end surfaces of the tubular member are $L_1$ and $L_2$, an opened end correction length is $\delta$, and n is an integer of 0 or more, at least one of $(\lambda_a/4-\lambda_a/8)+n\times\lambda_a/2-\delta\leq L_1\leq(\lambda_a/4+\lambda_a/8)+n\times\lambda_a/2-\delta$ or $(\lambda_a/4-\lambda_a/8)+n\times\lambda_a/2-\delta\leq L_2\leq(\lambda_a/4+\lambda_a/8)+n-\lambda_a/2-\delta$ is satisfied.

2. The soundproof structure according to claim 1,
wherein at least one of $(\lambda_a/4-\lambda_a/8)-\delta\leq L_1\leq(\lambda_a/4+\lambda_a/8)-\delta$ or $(\lambda_a/4-\lambda_a/8)-\delta\leq L_2\leq(\lambda_a/4+\lambda_a/8)-\delta$ is satisfied.

3. The soundproof structure according to claim 1,
wherein the wavelength $\lambda_a$ corresponding to the resonance frequency in the single film vibration element of the film member is a wavelength corresponding to a resonance frequency of a primary resonance mode of the film member.

4. The soundproof structure according to claim 2,
wherein the wavelength $\lambda_a$ corresponding to the resonance frequency in the single film vibration element of the film member is a wavelength corresponding to a resonance frequency of a primary resonance mode of the film member.

5. The soundproof structure according to claim 1,
wherein the film member is attached to one opened end surface of the tubular member.

6. The soundproof structure according to claim 4,
wherein the film member is attached to one opened end surface of the tubular member.

7. The soundproof structure according to claim 1,
wherein the film member is attached to a central position within the tubular member.

8. The soundproof structure according to claim 6,
wherein the film member is attached to a central position within the tubular member.

9. An opening structure comprising:
the soundproof structure according to claim 1; and
an opening member having an opening,
wherein the soundproof structure is arranged in the opening of the opening member, and a region as a venthole through which a gas passes is provided in the opening member.

10. An opening structure comprising:
the soundproof structure according to claim 8; and
an opening member having an opening,
wherein the soundproof structure is arranged in the opening of the opening member, and a region as a venthole through which a gas passes is provided in the opening member.

* * * * *